United States Patent [19]

Wold

[11] Patent Number: 4,773,160

[45] Date of Patent: Sep. 27, 1988

[54] SAW CHAIN HAVING RELIEVED CENTER LINK

[75] Inventor: John K. Wold, West Linn, Oreg.

[73] Assignee: Omark Industries, Inc., Portland, Oreg.

[21] Appl. No.: 939,418

[22] Filed: Dec. 8, 1986

[51] Int. Cl.[4] ..... B27B 33/14

[52] U.S. Cl. ..... 30/383; 30/381; 83/830

[58] Field of Search ..... 30/381, 383; 83/830, 83/831, 832, 833, 834, 853

[56] References Cited

U.S. PATENT DOCUMENTS 2,873,775 2/1957 Abbott .
2,924,110 2/1960 Gudmundsen ..... 83/853 X
3,291,169 12/1966 Morner .
3,292,670 12/1966 Ratz et al. .
3,329,183 7/1967 Robinson .

FOREIGN PATENT DOCUMENTS 815254 10/1951 Fed. Rep. of Germany ..... 83/830
1091557 11/1967 United Kingdom .

*Primary Examiner*—Frank T. Yost
*Assistant Examiner*—Michael D. Folkerts
*Attorney, Agent, or Firm*—Robert L. Harrington

[57] ABSTRACT

An articulated saw chain having pivotally interconnected center drive links and side links. The side links having bottom edges that incur splaying as a result of the side links pounding the guide bar rail during cutting action. An inset portion provided on the center links in the area of overlap defined by the bottom edge surface being pivoted relative to the center drive links. The insets thus providing added clearance to permit substantial splaying of the bar engaging bottom edge surface of the side links without interference and binding.

8 Claims, 2 Drawing Sheets

SAW CHAIN HAVING RELIEVED CENTER LINK

FIELD OF INVENTION

This invention relates to a center link in a saw chain and more particularly to a center link having specified areas of relief to alleviate binding.

HISTORY OF INVENTION

In the typical chain saw e.g. used for cutting logs, a loop of saw chain is entrained around a guide bar. The saw chain is made up of articulated links comprised of a repeating sequence of center links pivotally connected to mated pair of side links. The guide bar has a groove along its edge that receives a guide tang inwardly extending from the center link. This drive link tang insures the travel of the saw chain around the edge of the bar. The side links slide along the guide bar edge on either side of the groove. The guide bar edge is often referred to as the guide bar rail.

During cutting action (certain of the side links being provided with outwardly extended cutting portions), the saw chain is driven rapidly around the guide bar. This action generates a pounding of the bottom edges of the saw chain side links against the rails. These bottom edges of the side links develope burrs i.e. the material of the link spreads or splays as a result of the pounding. After some time an interference occurs as a result of these burrs or splayed portion, in the areas of overlap with the interconnected drive link. This is particularly troublesome as the chain travels around the guide bar ends where substantial relative pivoting or articulation of the links takes place. Initially, the links bend inwardly as the chain is wrapped around the sprocket end or nose end of the guide bar. Then the bend is reversed to a lesser degree as the links return to the straight reach position of the bar. Inhibiting this bending action can accelerate wearing and in some instances may increase the tendency for the chain to jump off the bar.

BRIEF DESCRIPTION OF INVENTION

The present invention alleviates the bending effect generated by the above-described interference, by the provision of a relieved area in the side of the drive link. These relieved areas are configured to accommodate the full range of overlap during articulation as between the center link and the bottom edge of the side links. Thus considerable splaying is permitted before any interference is developed. The pivoting action is considered in the configuration and thus the relieved area encompasses the area of overlap throughout the full range of relative pivoting. In general, the overlapping areas are just below the interconnecting rivets in the position where the saw chain travels along a straight reach of the bar edge. As the chain travels around the bar end, the overlapping area extends up between the rivets i.e. in the mid section of the center link between the rivets. As the chain returns to the straight reach, a slight reverse bending takes place. Thus the portion of the center link to be relieved e.g. as by coining, is configured in the form of curved areas below each rivet which represents the path of the bottom edge of the side links relative to the center link during articulation.

The invention will be more clearly understood by reference to the following detailed description and drawings wherein.

Figure 2:
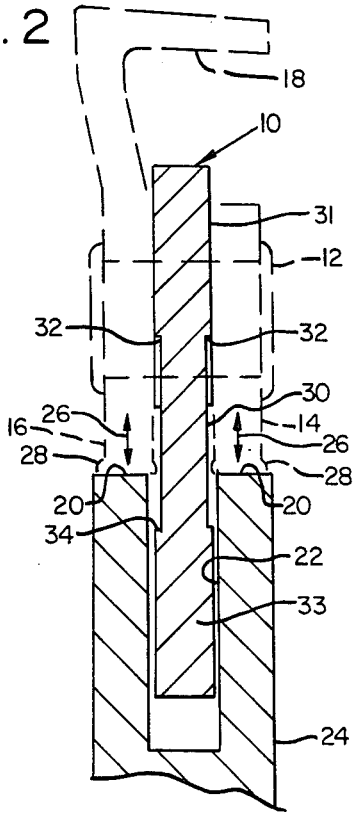
FIG. 2 is a section view taken on view lines 2–2 of FIG. 1 but showing the relationship of the center link relative to an interconnected pair of side links (in dash lines) entrained on the edge groove of a guide bar.

Reference is first made to FIG. 2 wherein a center link 10 is illustrated as being pivotally connected by a rivet 12 to a pair of side links 14, 16. Each of said links 10, 14 and 16 includes a body portion. Side link 16 is a cutting side link with a cutting portion 18 outwardly or upwardly extended from the body portion. The side links 14, 16 engage the edges 20 on either side of a groove 22 of a guide bar 24.

Figure 3:
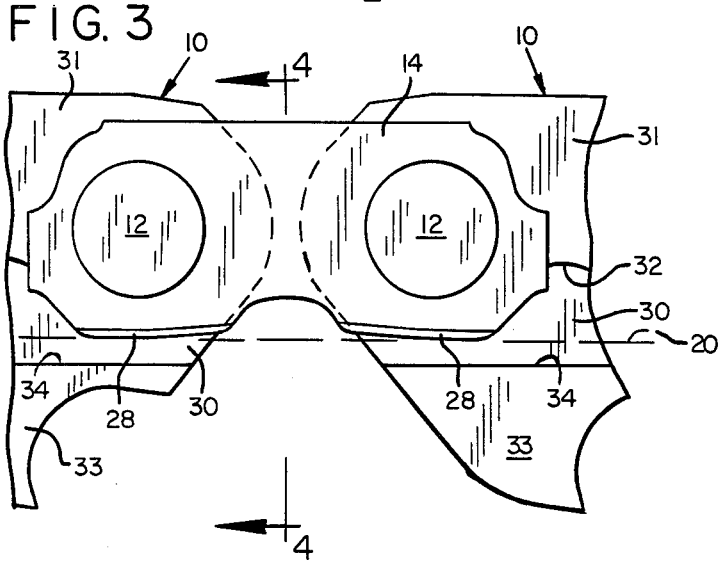
FIG. 3 is a side view of a side link illustrating the splayed bottom edge portions i.e. after extended use in a cutting operation.
Figure 4:
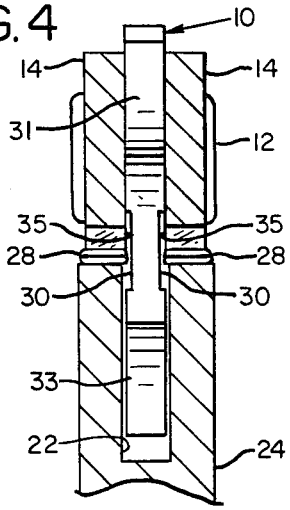
FIG. 4 is a sectional view as taken on section lines 4—4 of FIG. 3.

In a cutting action, the cutting side link 16 and the side link 14 connected to it, are repeatedly pivoted up and down against the bar edge 20 as indicated by arrows 26. This creates a slight splaying of the bar engaging portions of the side links as indicated at 28. (See also FIGS. 3 and 4 illustrating only side link 14.)

Figure 1:
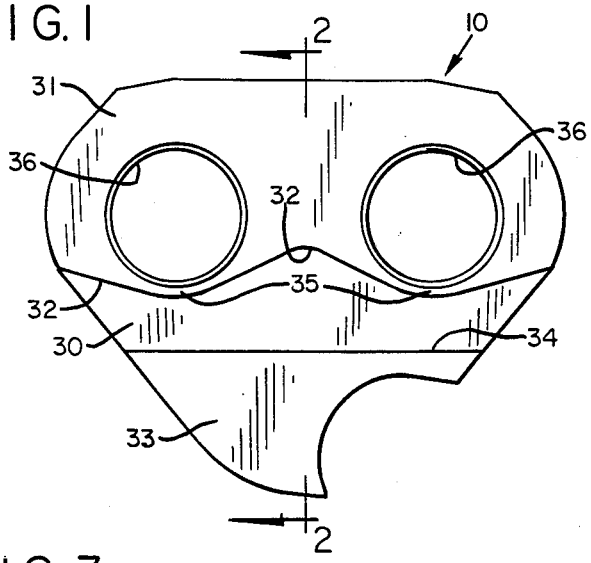
FIG. 1 is a side view of a center link in accordance with this invention.
Figure 5:
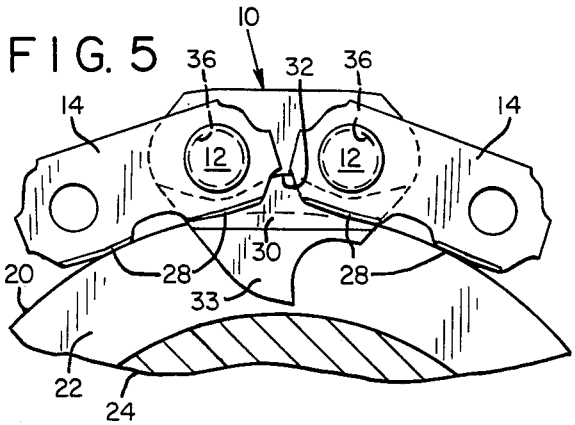
FIG. 5 is a side view illustrating the relationship of the center link and side links when rounding the nose of a guide bar; (the front rail of the bar being removed for illustration)
Figure 7:
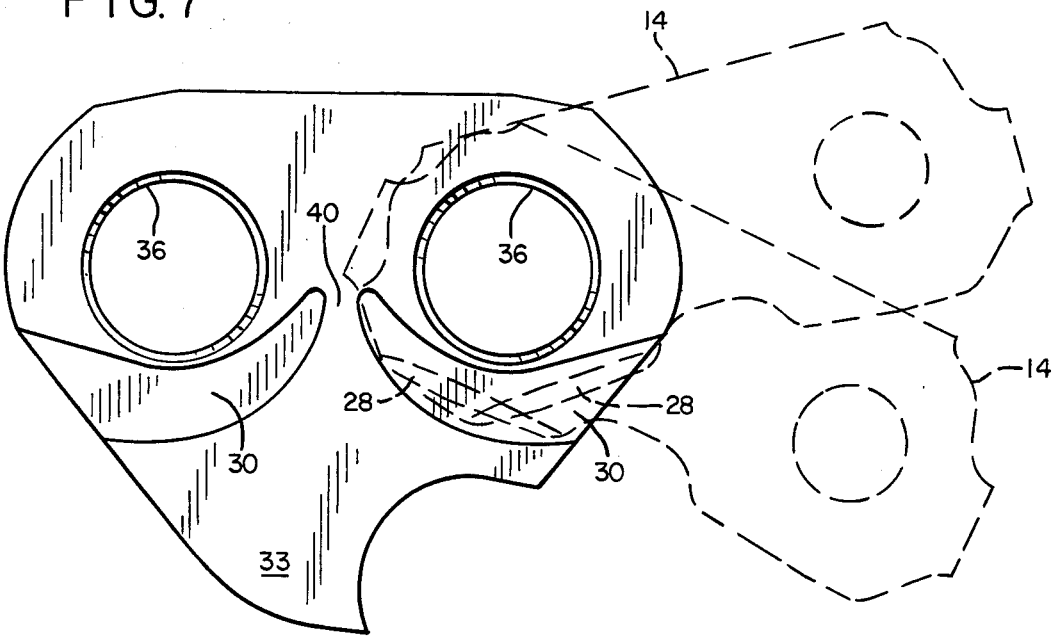
FIG. 7 is a view of a center link specifically outlining the curved areas below the rivet holes defined by the side link's bottom edge during articulation.

Now referring also to FIGS. 1 and 5, the center link 10 of the present invention is provided with a configured inset area 30 e.g. as by the process referred to as coining. This inset area 30 is bounded at the top by a curved upper edge 32 and a straight bottom edge 34. The bottom edge 34 represents the upper edge of tang portion 33 extended downwardly from the body portion and extending into the groove 22 of the guide bar 24. The thickness of the tang portion 33 that projects into the groove is mated to the groove width to enhance the stability of the chain. The configuration of the upper edge 32 is designed to provide an adequate depth of the thicker material of area 31 around the rivet holes 36, while being extended up between the rivet holes to accommodate the relative pivoting of the side links i.e. the pivoting of the splayed area 28 between the rivet holes as illustrated in FIGS. 5 and 7. This relative pivoting and thus the configuration of the edge 32 is dictated by the curved path that the saw chain takes around the nose of the bar 24.

In a specific embodiment of the invention, a center drive link 10 for a $\frac{3}{8}$ inch pitch chain was selected. The width of the center link in the area 30 is 0.008 inch less than in areas 31. In this example, tang portion 33 is the same width as portion 31, which as previously explained, is dictated by the bar groove width. Upon investigation, it was determined that pivoting of the links caused the splayed areas of the side links to pivot to a point just short of the mid point between the rivet. This is best illustrated in FIG. 7. Thus the apex of the upwardly curved portion of edge 32 in FIGS. 1 and 5 is substantially at the mid point between the rivet holes 36. The full thickness of the link is extended below the rivet hole opening (i.e. the distance 35) by about 0.010 inches.

The inset area 30 is inset from the full thickness providing substantial increased clearance for the increasing width of the splayed portion 28. (See FIG. 2).

Figure 6:
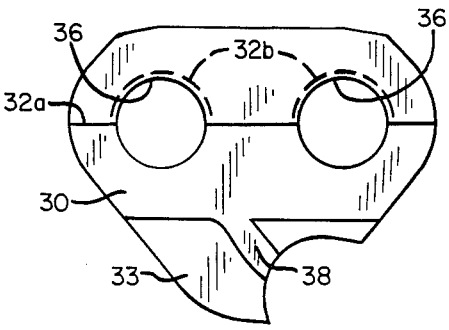
FIG. 6 is a side view of an alternate embodiment of a center link in accordance with this invention.

An alternate embodiment is illustrated in FIG. 6. This embodiment is intended for application of saw chain wherein the stress demands aren't so severe. Because the full thickness is not required below the rivet, the upper edge 32*a* is a straight line generated through the mid point of the rivets as shown. The coining is much simpler and provides access to the rivets for oiling. That is, an oil groove 38 will convey oil to the inset area 30 and thereby to the rivet. Of course, the oil groove is not a necessity.

In either of the embodiments of FIGS. 1 and 6, the bar groove may be adapted to accommodate the reduced thickness of the center link. That is, the coined area 30 may be extended down through the tang portion and thereby eliminate the defining edge 34. It is believed that this version has the benefit of simpler production.

The dash lines 32*b* indicate a still further modification. Forming the rivet hole of FIG. 6 is made more difficult with two different thicknesses of material through the hole area, i.e. the solid line of FIG. 6. Thus, the coined area 30 may include an area over the rivet holes as indicated by dash lines 32*b*.

Reference is now made to FIG. 7. The curved areas 30 in FIG. 7 represent the desired coined area. That is, these areas represent the minimum areas as defined by the splayed area 28 pivoting through a typical angular range of articulation, i.e. from about 15 degrees above the axis (a line passing through the center of the rivet holes) to about 26 degrees below the axis. The depth of the area 30 accommodates the splayed area 28 as the distance to the rivet hole shortens through wearing.

It will be observed from FIG. 7 that there is a small area 40 between the two coined areas 30 where coining is not necessary. It is pointed out that in either of the embodiments of FIGS. 1 or 6, a web of uncoined area can extend down the center of the link between the areas 31 and 33. This web of uncoined material may be desireable in adding stability as against side play.

Other modifications to the invention will become apparent to those skilled in the art. The scope of the invention is not limited to these illustrated embodiments however, but rather is encompassed by the claims appended hereto.

I claim:

1. A saw chain for mounting on a guide bar of a chain saw to be driven in part in a curved path around a guide bar nose, including;

a plurality of center drive links having a body portion and a downwardly directed tang, said body portion having opposed face surfaces, and spaced apart pin holes, side links alternating with said drive links in the chain having body portions with opposed face surfaces, bottom edges, and spaced apart rivet holes therein, rivets extending through said holes to pivotally interconnect said drive links and side links in face-to-face relation defining an area of overlap, said area of overlap being further determined by the included overlapping area during articulation therebetween in the curved travel of the saw chain around a guide bar nose, the bottom edges of the side links and including an area above said bottom edges to accommodate wearing, move through an area of interference that is within the area of overlap, said area of interference including an area that extends upwardly between the rivet holes to a height at least corresponding to the bottom of the rivet holes as necessary for relative pivoting of the links during the curved path of travel, and said area of interference being indented relative to a remaining portion of said area of overlap to alleviate interference between wearproducing lateral projections at the bottom surface of the side link and the face of the drive link in the area of interference.

2. In a saw chain having articulated links having plate-like body portions with side surfaces, said links including an alternating sequence of center drive links and pairs of side links, said center drive links having a drive tang adapted to extend downward from the body portion into an edge groove of a guide bar, said guide bar defining in part a curved path of travel, and said pairs of side links having rail-engaging bottom edge portions adapted to slidingly engage guide bar rails on either side of the bar-edge groove, connecting means for pivotally connecting said center drive links to said pairs of side links wherein side surfaces of the body portions of the pairs of side links are overlapped with side surfaces of the body portions of said center drive links in surface-to-surface sliding relationship due to the relative pivoting of the links during travel of the saw chain around the guide bar, said connecting means being rivets that pass through front and rear rivet holes provided in the center drive links and pairs of side links, the surface of overlap on the center links including an area of interference defined as that portion on the side surface of the center link that is overlapped by the bottom edge and that portion of the side surface above the bottom edge of the side links accommodating attrition of the bottom edge due to wear, said surface of overlap on the center links characterized by the area of interference therewithin being inset relative to a remaining portion of said surface of overlap, and said area of interference including a surface area that extends upwardly between the front and rear rivet holes to a height at least corresponding to the bottom of the rivet holes as necessary for relative pivoting of the links during the curved path of travel.

3. In a saw chain as defined in claim 1, said remaining portion of overlap on the center links including an area completely surrounding each of the rivet holes.

4. In a saw chain as defined in claim 3, said inset areas having a lower boundary that substantially represents the upper edge of the tang portion adapted to project into the bar edge groove.

5. In a saw chain as defined in claim 2, said inset areas being inset from the remaining portion of overlap by a distance within a range of about 0.002 to 0.008 inches.

6. In a saw chain as defined in claim 2, said inset areas having an upper boundary distinguishing it from said remaining portions of overlap that is a straight line along the length of the center link and passing through said front and rear rivet holes.

7. In a saw chain as defined in claim 6, said center link having a tang portion below said inset portion of greater thickness than said inset portion, and an oil groove formed in said tang portion for directing oil flow from said bar groove into said inset portion and thereby into the front and rear rivet holes.

8. In a saw chain as defined in claim 4, a web of material extended between the upper and lower boundaries of the inset portion at the mid point between the rivet hole openings that is outside the area of inset, said web of material having a thickness at least the thickness of the tang portion.

* * * * *